United States Patent [19]

Featherstone et al.

[11] 4,172,113

[45] Oct. 23, 1979

[54] PRODUCTION OF COSMETIC-FILLED CONTAINERS

[75] Inventors: James Featherstone, Bournemouth, England; Jean P. Vercelot, Saint Maur, France

[73] Assignee: Sebec S.A., Friebourg, Switzerland

[21] Appl. No.: 841,904

[22] Filed: Oct. 13, 1977

Related U.S. Application Data

[63] Continuation of Ser. No. 406,381, Oct. 15, 1973, abandoned.

[30] Foreign Application Priority Data

Oct. 17, 1972 [GB] United Kingdom ..... 47788/72

[51] Int. Cl.[2] ..... B29C 5/00; B29C 25/00

[52] U.S. Cl. ..... 264/319; 264/345; 425/DIG. 32

[58] Field of Search ..... 264/80, 267, 319, 345, 264/348; 425/DIG. 32, 803

[56] References Cited

U.S. PATENT DOCUMENTS

| | | | |
|---|---|---|---|
| 2,263,302 | 11/1941 | Johnson | 425/507 |
| 2,589,143 | 3/1952 | Rus | 141/70 |
| 2,960,425 | 11/1960 | Sherman | 156/82 |

FOREIGN PATENT DOCUMENTS

| | | | |
|---|---|---|---|
| 757549 | 4/1967 | Canada | 264/267 |
| 1101033 | 1/1968 | United Kingdom . | |

*Primary Examiner*—W. E. Hoag

*Attorney, Agent, or Firm*—Scrivener, Parker, Scrivener & Clarke

[57] ABSTRACT

In the casting of cosmetics, such as lipstick material into open-topped molds which may, be associated with or placed within inverted containers, the molds are, after casting, passed beneath downwardly directed jets of heated air which impinge on the surface of the cosmetic material to counteract piping and they may also be passed beneath downwardly directed jets of cooled air to hasten setting.

2 Claims, 3 Drawing Figures

PRODUCTION OF COSMETIC-FILLED CONTAINERS

This is a continuation of application Ser. No. 406,381, filed Oct. 15, 1973 now abandoned.

This invention relates to the production of containers filled with cosmetic material, primarily lipstick containers. Instead of inserting pre-formed shape sticks of lipstick into the finished containers it has been proposed to provide a shaped hollow mould, for example of transparent synthetic resin, which fits onto the movable cup or godet of the container, and to provide holes in the bottom of the cup and of the container itself so that if the container is placed in an inverted position beneath a pouring nozzle fed from a tank of molten lipstick material the stick can be cast directly into the container.

It has also been proposed to provide a shaped hollow mould below the inverted container to mate with the cup or godet during casting of the stick, the mould being withdrawn downwards as soon as the stick has become solidified.

It is known that, during solidification of the molten material, appreciable shrinkage takes place, and this can lead to 'piping' in a manner exactly the same as occurs in the casting of metal ingots. In metal casting this is solved by the use of so-called 'hot-tops' which keep the top end of the casting hot for longer than the remainder, so that this top portion acts as a reservoir of molten material to make up the shrinkage in the lower part and prevent the formation of a central void or 'pipe'.

In the casting of lipstick it has been proposed to provide an extension sleeve above the cup or godet, this sleeve receiving an extra portion of molten lipstick mass which forms a reservoir for the mass below during shrinkage, and which also contains any 'pipe' that may form. The extra portion is subsequently removed and remelted; however this involves an extra step and has an adverse effect on the mass, which deteriorates when repeatedly remelted.

It has been proposed instead to apply heat to the upper end of the cast body, by means of radiant heaters as the container moves away from the filling point, so that the upper end forms a 'hot top' and remains molten longer than the remainder, feeding the remainder and preventing the formation of a 'pipe' or void. In this prior proposal, which forms the subject of British Letters Patent No. 1 101 033 of Kolmar, a line of filled containers, passing from the filling machine, moves horizontally under a battery of downwardly facing radiant heaters. A drawback of this arrangement, especially where the lipstick container assemblies already include an outer sleeve and a base, which in practice can only have a relatively small hole, is that it is necessary to apply a lot of heat, most of it unwanted, to the base end of the container in general in order to ensure that sufficient heat penetrates to the mass within the cup or godet.

The aim of the invention is to overcome this problem. According to the invention it is proposed that the lipstick or other cosmetic material cast into a sheath or mould, for example in or through a cup or godet of a lipstick container, should be heated or cooled by directing a jet of heated or refrigerated air substantially vertically downwards onto the exposed surface of the cast material.

In this way the heat reaches the point where it is needed without unnecessary heating of the surrounding parts, and so it is possible to achieve the necessary 'hot top' condition will less overall heat input, with the result that the cooling and setting process takes place more quickly, yet still without the formation of shrinkage voids or 'pipes'.

Preferably the containers embodying the sheaths or moulds are moved intermittently beneath a line of air-emitting nozzles such that each cast body of material is subjected to several successive jets of air. The nozzles can be in the lower face of an elongated hollow body, and this body can contain any electric element to provide the necessary heat.

The invention will now be further described by way of example with reference to the accompanying drawings, in which.

Figure 1:
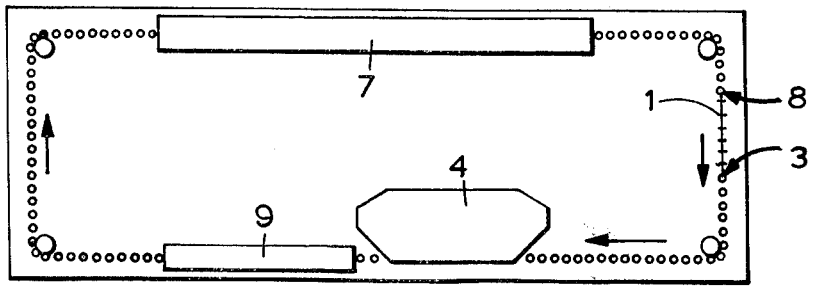
FIG. 1 is a diagrammatic plan view of a lipstick container filling machine to which the invention can be applied.

Referring first to FIG. 1, the machine shown is of a basically known kind in which an endless conveyor chain 1 carries a series of lipstick containers 2 (FIG. 2) each disposed vertically but inverted, from a loading point 3 past a filling station 4 in which a predetermined quantity of molten lipstick material is poured through an aperture in the bottom of the container into a mould 5 (see FIG. 3) fitting onto the vertically movable cup or godet 6 of the container. This is known as the Ejectoret process (Registered Trade Mark). The containers are subsequently carried round through a cooling station 7 at which the lipstick material is cooled to set it sufficiently hard for the containers to be removed at a discharging station 8. The chain moves intermittently, being stationary while the molten lipstick is being poured and then indexing forwards by a distance equal to the spacing between two adjacent containers. In an alternative form of machine there could be two filling heads side by side and operating simultaneously in which case the machine could index through twice this distance.

As explained above, if the cast material solidifies throughout too quickly, shrinkage results in the formation of 'pipes' or voids in the upper end of the cast stick and it is therefore desirable to keep the top end of the setting molten material hot for longer than the remainder. For this purpose we provide the heating device 9, shown in detail in FIG. 2.

The device comprises a horizontally elongated hollow body 10 of a machineable refractory non-metallic incombustible material, such as that sold under the Registered Trade Mark "Sindanyo". It is externally of square cross-section and has a bore of circular cross-section containing an electric heating element 11. The right hand end is closed by a plug 12 and the left hand end has a plug 13 which supports the element 11 and a cap 14 which protects the terminals 15 of the element 11 and also clamps a flexible cable (not shown) through which the element is supplied with current.

Figure 2:
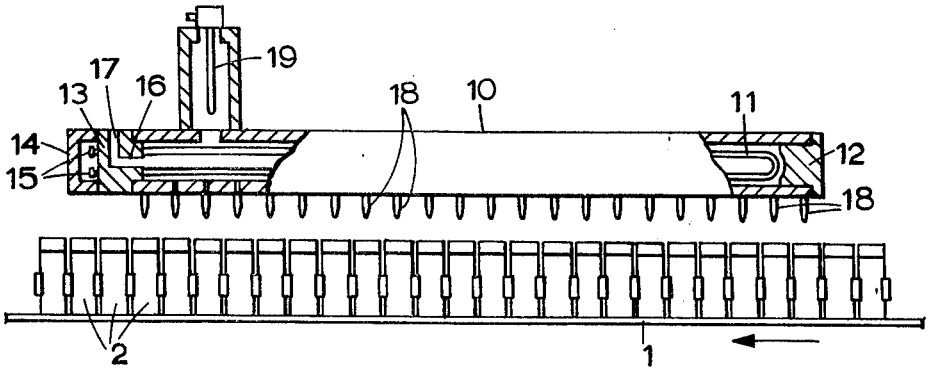
FIG. 2 is an elevation, to a larger scale, of the hot air heating device and its relationship to the containers.
Figure 3:
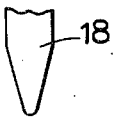
FIG. 3 is a partially sectioned detail view to a still larger scale showing the relationship of a lipstick container to a nozzle of the heating device, the container being shown partly cut away.
Figure 3:
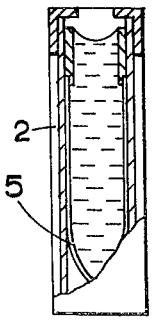

Also in the plug 13 is a central axial hole 16 intersecting a radial hole 17 for connection to a low-pressure compressed air supply (not shown) by which air is fed to the interior of the body 10. Screwed into the lower face of the body there is a row of outlet nozzles 18 for the air, spaced apart by a distance equal to the spacing between the containers on the chain 1. As shown in FIG. 2, the device 9 is placed so that, during the periods when the chain 1 is stationary, i.e. while a container is being filled at the station 4, there is a recently filled container under each of the nozzles 18. Each container is indexed along to pass under each nozzle in turn. It will be appreciated that each nozzle directs heated air down through the open bottom end of the container to impinge directly on the surface of the solidified or solidifying lipstick material, thus applying the heat exactly where it is needed and avoiding any unnecessary heating of the surrounding components.

A thermostat 19 mounted in the top of the body 10 controls the supply of current to the element 11 to keep the temperature of the air issuing from the nozzles 18 substantially constant.

In the device illustrated, suitable for a machine filling up to as much as 2,400 containers an hour (i.e. with an indexing interval of 1½ seconds) the heater has a capacity of 800 watts. The body 10 is 625 mm long and has 23 nozzles in a line at a spacing of 25 mm. The pressure at which the air is supplied to the inlet of the device is variable between zero and twenty inches (water gauge).

It will be understood that the dimensions, the number of nozzles and other variable factors can be selected according to the speed of the chain, the cooling characteristics of the lipstick material and other influences. Moreover the nozzles could have different sizes. In the example shown the outlet end of each nozzle has an internal diameter of 2.38 mm, but it would be possible, for example, to make the nozzles at the right-hand end larger than those at the left-hand end so as to increase the rate of heating to the containers as they reach the device and then progressively reduce it as they pass along.

The device could be curved in plan view, to suit a rotary indexing filling machine. Also it will be understood that, instead of filling complete containers provided with moulds in the form of sheaths, the machine could be of a kind in which the container into which the molten mass is cast or simply a mould from which the resulting stick is subsequently removed. For example it could be a mould formed partly by a godet or cup within an inverted lipstick container and partly by a cavity in a body which temporarily engages the cup or godet and is then subsequently separated from it within the machine, as soon as the lipstick has solidified.

Also, instead of the air being heated by an element 11 within the body 10, the air might be heated at a remote point and enter the body 10 already hot, in which case the element 11 could be omitted.

Finally, it has been found that the 'piping' may also be prevented not by heating or re-heating the upper end of the solidifying body of lipstick but by cooling it rapidly, and so the device according to the invention may be used for cooling rather that heating. In that case there would be no heating element and instead there might be a refrigerating coil in the body 10 but, much more simply, one would feed to the body a supply of refrigerated air, for example, from a refrigeration unit already present for the cooling station 7. Again, the device would direct the jets of air exactly where required, that is to say, into the open ends of the containers to impinge directly on the surface of the solidified or solidifying material.

A further possibility is that two of the units described may be used, one supplying hot air for the avoidance of 'piping' and the other supplying cold air to hasten the final setting of the lipstick.

We claim:

1. The method of suppressing piping in solidifying cosmetic material cast into a line of successive horizontally spaced moulds each having a restricted opening in its upper end through which the material is cast into the moulds, comprising the steps of providing a line of vertically downwardly directed horizontally spaced jets of heated air, moving each of said moulds successively intermittently beneath each of said jets, causing each mould to dwell beneath each of said jets with said restricted opening in axial alignment with said jet to enable the heated air to enter said moulds through said restricted openings into direct intimate contact with the top portions of said cast cosmetic material in said moulds to heat substantially only the top portion of said cast cosmetic material without substantially heating said moulds, thereby delaying solidification of said top portions sufficiently to suppress piping while permitting subsequent cooling and setting of said material more quickly than would be possible if the entire mould were to be heated to a level sufficient to suppress piping in said cosmetic material.

2. In the casting of lipstick directly into finished lipstick containers of the type which carries therein an axially adjustable sleeve normally receiving and supporting the base of the solidified lipstick, said sleeve detachably carrying a plastic mould, said lipstick material in molten state being cast into said sleeve and mould through a restricted opening in the base of the inverted container, the method of suppressing piping in the cast lipstick material as it solidifies comprising the steps of providing a line of vertically downwardly directed, horizontally spaced jets of heated air, moving each of said containers successively beneath each of said jets, causing each container to dwell beneath each of said jets with said restricted opening in axial alignment with said jet to enable the heated air to enter said container vertically through said restricted openings into direct intimate contact with the base portions of said cast cosmetic material in said mould and sleeve to heat substantially only the base portion of said cast cosmetic material without substantially heating said containers, thereby delaying solidification of said base portions sufficiently to suppress piping while permitting subsequent cooling and setting of said material more quickly than would be possible if the entire container were to be heated to a level sufficient to suppress piping in said cosmetic material.

* * * * *